US007926458B2

(12) United States Patent
Naito et al.

(10) Patent No.: US 7,926,458 B2
(45) Date of Patent: Apr. 19, 2011

(54) LUBRICATING DEVICE

(75) Inventors: Masahiro Naito, Hiroshima (JP); Shigemi Okada, Hiroshima (JP); Jun Yamane, Hiroshima (JP)

(73) Assignee: Mazda Motor Corporation (JP)

( * ) Notice: Subject to any disclaimer, the term of this patent is extended or adjusted under 35 U.S.C. 154(b) by 407 days.

(21) Appl. No.: 12/202,636

(22) Filed: Sep. 2, 2008

(65) Prior Publication Data

US 2009/0056658 A1 Mar. 5, 2009

(30) Foreign Application Priority Data

Sep. 5, 2007 (JP) ..... 2007-230603

(51) Int. Cl.
*F01M 1/06* (2006.01)

(52) U.S. Cl. ..... 123/90.33; 123/90.34; 123/90.39; 123/90.44; 123/90.6; 123/196 M

(58) Field of Classification Search ..... 123/90.16, 123/90.17, 90.33, 90.34, 90.39, 90.44, 90.6, 123/193.3, 193.5, 196 M, 196 R, 195 C; 74/559, 567, 569

See application file for complete search history.

(56) References Cited

U.S. PATENT DOCUMENTS

| | | | | |
|---|---|---|---|---|
| 4,343,270 | A | 8/1982 | Kawabe | |
| 5,492,086 | A | 2/1996 | Kuhns | |
| 6,631,701 | B2 * | 10/2003 | Seader et al. | 123/90.34 |

FOREIGN PATENT DOCUMENTS

| | | |
|---|---|---|
| EP | 1403497 | 3/2004 |
| FR | 2464364 | 3/1981 |
| FR | 2746846 | 10/1997 |
| JP | 2001-329832 | 11/2001 |

OTHER PUBLICATIONS

Jean Mouton, "European Search Report", EP 08014376, Dec. 18, 2008.

* cited by examiner

*Primary Examiner* — Ching Chang
(74) *Attorney, Agent, or Firm* — Studebaker & Brackett PC; Donald R. Studebaker

(57) ABSTRACT

A lubricating device comprises a cam shaft, plural cam portions for each valve provided at the cylinder head, a valve driving mechanism to change a rotational movement of the cam portion to an opening-and-closing movement of the valve via a slide member on which a peripheral surface of the cam portion slides, an oil passage of the cam shaft, a nozzle provided at either one of the cam portions to open at the peripheral surface of the cam portion and connect to the oil passage of the cam shaft, and a wall body having a recess portion. The recess portion collects lubricating oil ejected out of the nozzle and guides the lubricating oil collected to the peripheral surface of the other cam portion when the one cam portion is located in a position in which the nozzle is not directed to the slide member.

6 Claims, 7 Drawing Sheets

LUBRICATING DEVICE

BACKGROUND OF THE INVENTION

The present invention relates to a lubricating device for a valve driving mechanism of an engine.

Lubricating slide portions located between a cam shaft and a journal bearing or between a cam portion and a rocker arm or a valve lifter may be required for a valve driving mechanism. Japanese Patent Laid-Open Publication No. 2001-329823, for example, discloses a lubricating device for the driving mechanism, in which at an inner-wall ceiling face of a cylinder head cover (rocker cover) is provided an oil guide portion which collects lubricating oil spread by a chain transmitting an output of a crank shat of a single-cylinder engine to a cam shaft and guides the collected lubricating oil to the valve driving mechanism. It may be difficult to guide the lubricating oil to a specified portion which is located away from the chain according to the above-described lubricating device. Thus, this lubricating device may not be properly applied to a valve driving mechanism for a multi-cylinder engine.

Meanwhile, a lubricating device for the multi-cylinder engine, which comprises an oil passage of lubricating oil formed inside a cam shaft and a nozzle which is provided so as to open at a peripheral surface of a shaft portion of the cam shaft or a cam portion and connect to the oil passage formed inside the cam shaft, has been put to practical use. This lubricating device may enable a proper lubricating of respective slide portions.

Herein, in a case in which the lubricating oil is ejected out of the nozzle opening at the peripheral surface of the cam shaft and the slide portion, such as the peripheral surface of the cam portion and the rocker arm, are lubricated by the lubricating oil ejected, there may occur two states: a state in which the nozzle is directed to the slide portion; another state in which the nozzle is not directed to the slide portion, in accordance with the position change of the cam portion caused by the rotation of the cam shaft. Although the lubricating oil is supplied to the slide portions while the cam shaft is so positioned that the nozzle is directed to the slide portion, the supply of the lubricating oil to the slide portion is not conducted when the cam shaft is so positioned that the nozzle is not directed to the slide portion. Therefore, the lubricating oil ejected out of the nozzle would be ejected wastefully into a vale-driving chamber. Further, as the number of intake/exhaust valves increases, the number of nozzles also increases accordingly. Thus, the amount of such wasteful lubricating oil ejected would increase. The increase of the amount of lubricating oil may increase the burden of a pump to supply the lubricating oil. Since the pump is generally driven by the engine, such increase of the amount of lubricating oil may cause the increase of the burden of the engine. As a result, the fuel economy of the engine would deteriorate.

SUMMARY OF THE INVENTION

Accordingly, an object of the present invention is to provide a lubricating device which can ensure a proper lubricating of the peripheral surface of the cam portion, decreasing the amount of the lubricating oil.

According to the present invention, there is provided a lubricating device, comprising, a cam shaft provided at a cylinder head, a plurality of cam portions provided at the cam shaft for each valve provided the cylinder head, a valve driving mechanism operative to change a rotational movement of the cam portion to an opening-and-closing movement of the valve via a slide member on which a peripheral surface of the cam portion slides, an oil passage formed inside the cam shaft, a nozzle provided at either one of the cam portions which are disposed side by side so as to open at the peripheral surface of the cam portion and connect to the oil passage formed inside the cam shaft, a wall body having a recess portion, the recess portion being operative to collect lubricating oil ejected out of the nozzle and guide collected lubricating oil to the peripheral surface of the other of the cam portions when the one of the cam portions is located in a position in which the nozzle thereof is not directed to the slide member.

According to the lubricating device of the present invention, the above-described one of the cam portions has the above-described nozzle to supply the lubricating oil, and the other one does not such nozzle. Thereby, the number of nozzles can be reduced, so that the amount of the lubricating oil can be reduced. Meanwhile, the supply of the lubricating oil to the other cam portion described above can be achieved by the lubricating-oil guidance of the recess portion. Thereby, the lubricating between the peripheral surface of the other cam portion and the slide member can be ensured as well.

According to an embodiment of the present invention, the recess portion is configured such that the width thereof becomes narrower toward the other of the cam portions. Thereby, the amount of the collection of the lubricating oil ejected out of the nozzle can be properly increased, and the collected lubricating oil can be guided properly to the other cam portion.

According to another embodiment of the present invention, at a bottom face of the recess portion are provided a plurality of projections which extend toward the other of the cam portions. Thereby, the lubricating oil collected by the recess portion can be guided further properly to the other cam portion.

According to another embodiment of the present invention, the wall body is a cylinder head cover, or the wall body is a baffle plate which forms an oil-separating chamber inside a cylinder head cover. Thereby, the wall body can be used as parts which perfumes plural functions, so that the number of parts can be properly reduced.

According to another embodiment of the present invention, the cam portions which are disposed side by side are cam portions for two intake or exhaust valves which are provided each cylinder. Thereby, the length of the recess portion can be made properly short, so that the guidance of the lubricating oil to the other cam portion can be achieved surely.

Other features, aspects, and advantages of the present invention will become apparent from the following description which refers to the accompanying drawings.

DETAILED DESCRIPTION OF THE INVENTION

Hereinafter, a lubricating device according to preferred embodiments of the present invention, which is applied to a 4-cylinder inline diesel engine equipped with two intake valves and two exhaust valves for each cylinder and a DOHC type of valve-driving mechanism, will be described.

Figure 1:
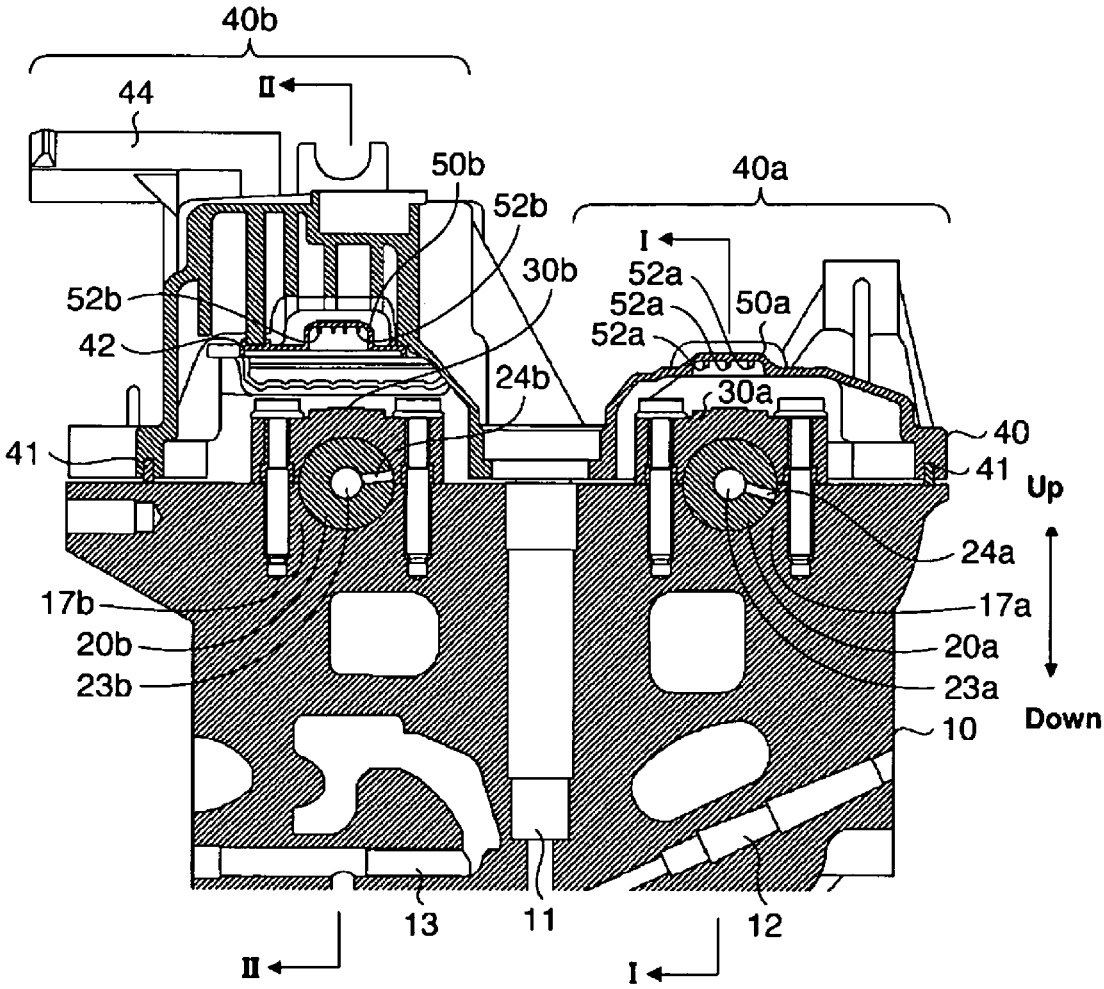
FIG. 1 is a sectional view, which is taken along a face perpendicular to a cylinder line, of a cylinder head 10 and its surroundings of a diesel engine equipped with a lubricating device according to an embodiment of the present invention.
Figure 2:
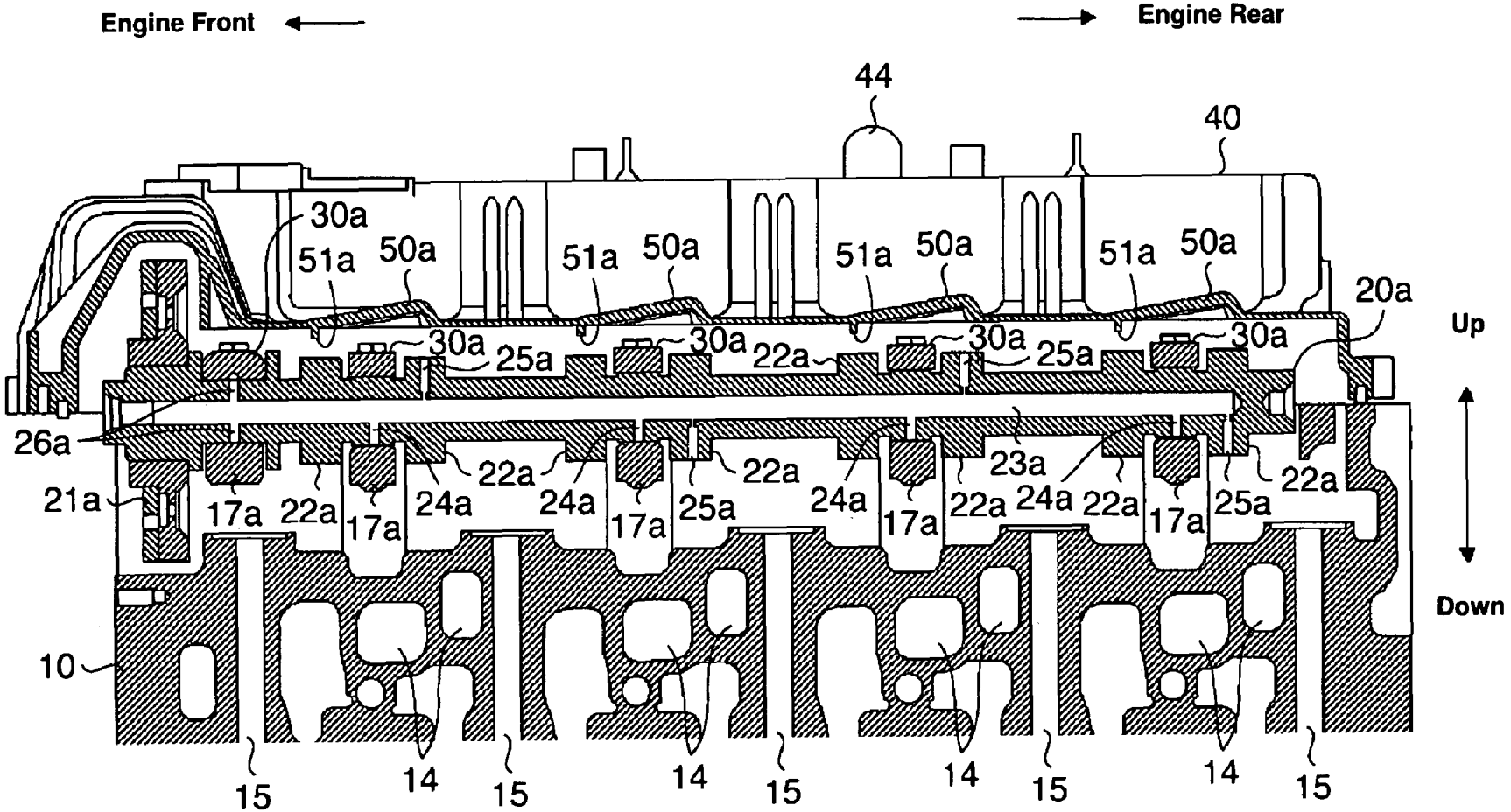
FIG. 2 is a sectional view taken along line I-I of FIG. 1.
Figure 3:
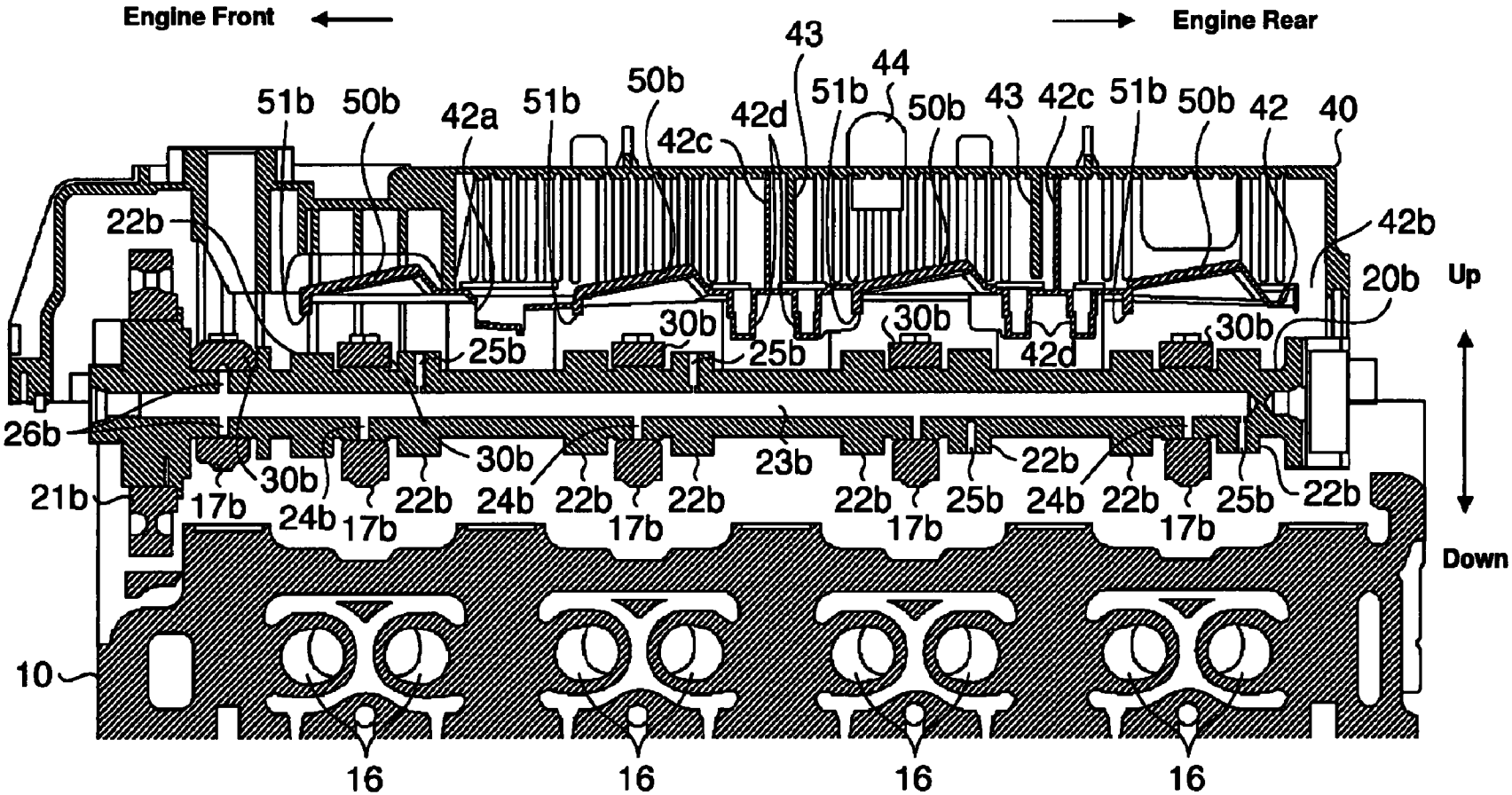
FIG. 3 is a sectional view taken along line II-II of FIG. 1.

FIG. 1 is a sectional view, which is taken along a face perpendicular to a cylinder line, of a cylinder head 10 and its surroundings of the diesel engine equipped with the lubricating device according to an embodiment of the present invention. FIG. 2 is a sectional view taken along line I-I of FIG. 1. FIG. 3 is a sectional view taken along line II-II of FIG. 1. Illustration of other structures of the valve-driving mechanism than cam shafts 20 is omitted in these figures.

As shown in FIG. 1, the cylinder head 10 has an accommodation space 11 for a fuel injector (not illustrated), another accommodation space 12 for a glow plug (not illustrated), and a water jacket 13, which are formed therein. The cylinder head 10 forms respective combustion chambers together with a cylinder block, not illustrated, which is disposed under the cylinder head 10. As shown in FIG. 2, the cylinder head 10 has two intake ports 14 for each cylinder and holes 15 for bolts for fixing the cylinder head 10 to the cylinder block (not illustrated). As shown in FIG. 3, the cylinder head 10 has two exhaust ports 16 for each cylinder.

As shown in FIGS. 1 through 3, at an upper portion of the cylinder head 10 are provided a cam shaft 20*a* for intake valves and a cam shaft 20*b* for exhaust valves. The cam shafts 20*a*, 20*b* are rotatably supported respectively at journal bearings 17*a*, 17*b* and cam caps 30*a*, 30*b*, which are provided at the upper portion of the cylinder head 10. Gears 21*a*, 21*b* are provided at respective front ends of the cam shafts 20*a*, 20*b* so as to engage with one another. A sprocket (not illustrated) is provided at the front end of the cam shaft 20*b*. An engine output is transmitted from a crank shaft (not illustrated) to the sprocket via a chain or the like, so that the cam shafts 20*a*, 20*b* are rotationally driven.

The cam shafts 20*a*, 20*b* have plural cam portions 22*a*, 22*b* respectively. According to the present embodiment, the cam portions 22*a*, 22*b* are formed integrally to the cam shafts 20*a*, 20*b*. The respective cam portions 22*a*, 22*b* are provided at the cam shafts 20*a*, 20*b* with a specified distance therebetween such that two sets of cam portions 22*a*, 22*b*, 22*a*, 22*b* are respectively provided for each cylinder.

Further, oil passages 23*a*, 23*b* of the lubricating oil are formed inside the cam shafts 20*a*, 20*b* respectively so as to extend in an axis direction of the cam shafts. Also, the cam shafts 20*a*, 20*b* have nozzles 24*a*, 25*a*, 24*b*, 25*b* which connect to the oil passages 23*a*, 23*b* respectively.

The nozzles 24*a*, 24*b* are formed so as to open at the respective surfaces of specified portions of the cam shaft 20*a* which are respectively supported at the lower journal bearings 17*a*, 17*b* and the cam caps 30*a*, 30*b*. Thereby, such support portions are lubricated by the lubricating oil supplied via the nozzles 24*a*, 24*b*. Meanwhile, the nozzles 25*a*, 25*b* are formed so as to open at the respective peripheral surface of cam-profile bases of the cam portions 22*a*, 22*b*. Thereby, the lubricating oil supplied via the nozzles 25*a*, 25*b* are supplied to respective slide portions between the cam portions 22*a*, 22*b* and respective rocker arms as slide members, on which the respective peripheral surfaces of the cam portions 22*a*, 22*b* slide. According to the present embodiment, the nozzles 25*a*, 25*b* are provided for either one of the two sets of cam portions 22*a*, 22*b*, 22*a*, 22*b* of each cylinder (rear-side cam portions 22*a*, 22*b*).

The cam shafts 20*a*, 20*b* have respective lubricating-oil inlet holes 26*a*, 26*b* which connect to the oil passages 23*a*, 23*b* at front end portions thereof. The lubricating oil provided by an oil pump (not illustrated) driven by the engine is supplied to the respective oil passages 23*a*, 23*b* via passages (not illustrated) in the cylinder head 10 and the above-described inlet holes 26*a*, 26*b*.

As shown in FIG. 1, the upper face of the cylinder head 10 is covered with a cylinder head cover 40, which comprises a portion 40*a* which covers an intake-side valve driving mechanism and a portion 40*b* which covers an exhaust-side valve driving mechanism. A seal member 41 is provided at a bottom peripheral edge of the cylinder head cover 40. At first, the portion 40*a* of the cylinder head cover 40 will be described.

Figure 4:
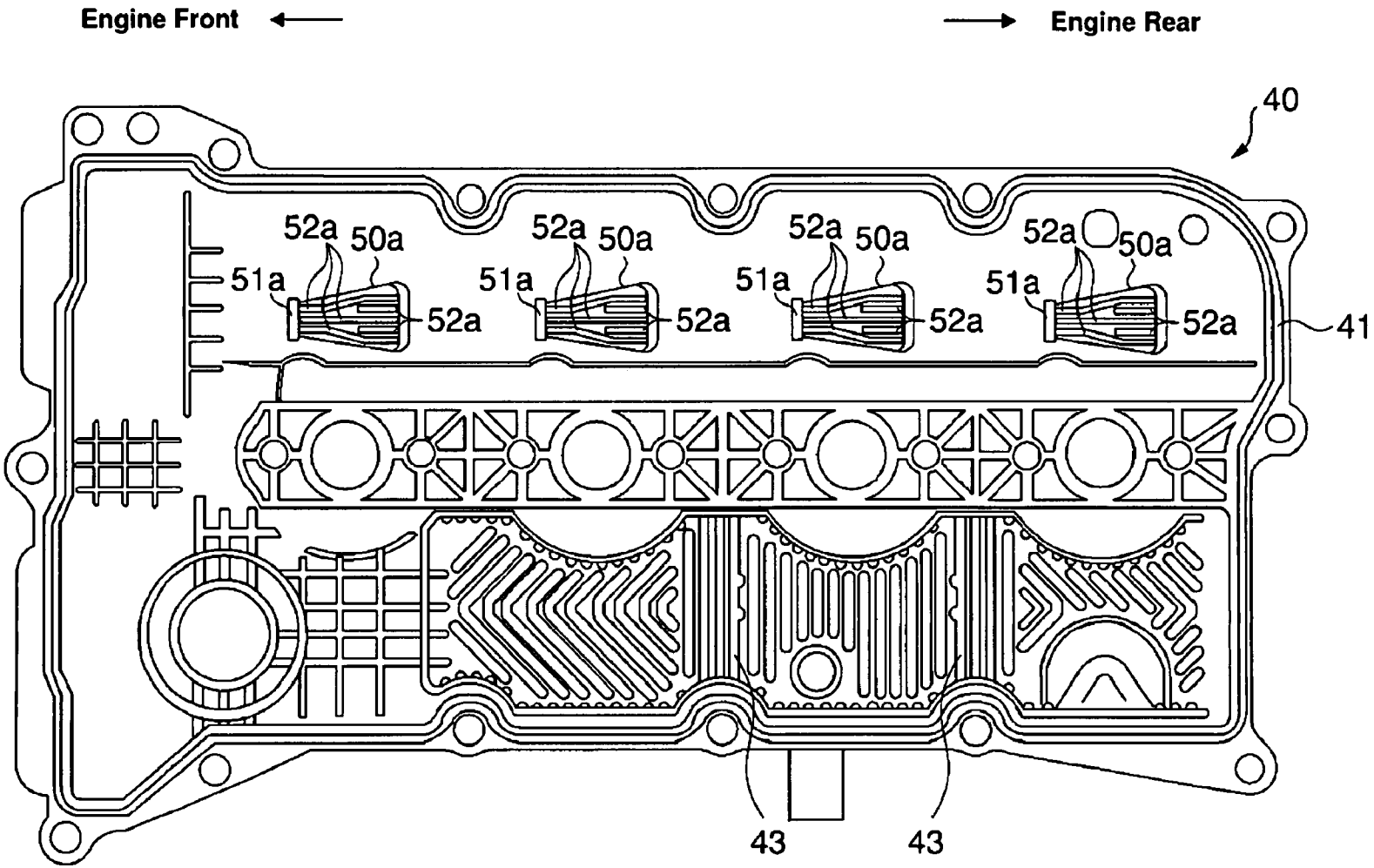
FIG. 4 is a bottom view of a cylinder head cover 40.

The portion 40*a* forms a ceiling wall of a chamber of the intake-side valve driving mechanism. FIG. 4 is a bottom view of the cylinder head cover 40. The portion 40*a* has a recess portion 50*a*, which is formed so as to be recessed upward for each cylinder. As shown in FIG. 2, the recess portion 50*a* has a section thereof which is of a reverse-V shape. The recess portion 50*a* is formed such that a slant of a portion thereof on an engine rear side is steeper than that on an engine front side. The apex of the recess portion 50*a* is located above the nozzle 25*a*. Further, a projection 51*a* which projects downward is provided at an engine-front-side end portion of the recess portion 50*a*. The projection 51*a* is located above the cam portion 22*a* disposed on the engine-front side. Further, as shown in FIG. 1, the recess portion 50*a* has a gate-shaped section thereof which is perpendicular to the axis direction of the cam shaft 20*a*.

As shown in FIGS. 1 and 4, at the bottom face of the recess portion 50*a* are provided a plurality of projections 52*a* which extend from the one cam portion 22*a* toward the other cam portion 22*a* (in other words, in the axis direction of the cam shaft 20*a*) and project downward. The projection 52*a* includes a straight portion and a bent portion. Further, as shown in FIG. 4, the recess portion 50*a* is configured such that the width thereof becomes narrower toward the engine-front-side cam portion 22*a*.

Next, the portion 40*b* of the cylinder head cover 40 will be described. As shown in FIGS. 1 and 3, the portion 40*b* encloses a chamber of the exhaust-side valve driving mechanism and forms an oil-separating chamber. Inside the portion 40*b* is provided a baffle plate 42, which forms a bottom wall of the oil-separating chamber and the ceiling wall of the camber of the exhaust-side valve driving mechanism.

Referring to FIG. 3, blow-by gas which has occurred inside the engine cylinders flows into the oil-separating chamber, which is enclosed by the baffle plate 42 and the cylinder head cover 40, from the engine-front side via an inlet 42*a* formed at the baffle plate 42 or from the engine-rear side via a gap 42*b* formed between an engine-rear end of the baffle plate 42 and the cylinder head cover 40.

The cylinder head cover 40 comprises two obstacle plates 43 which project downward with a specified distance in the engine longitudinal direction. There exists a small gap between the lower end of the obstacle plate 43 and the baffle plate 42, through which the blow-by gas flows. The baffle plate 42 includes two separating walls 42*c* which project upward and are disposed close to the obstacle plates 43 with a specified distance therebetween in the engine longitudinal direction. Each partition wall 42*c* has a through hole through which the blow-by gas flows, and the obstacle plates 43 and the partition walls 42*c* provide a flow resistance to the blow-by gas flowing between the chambers.

Figure 5:
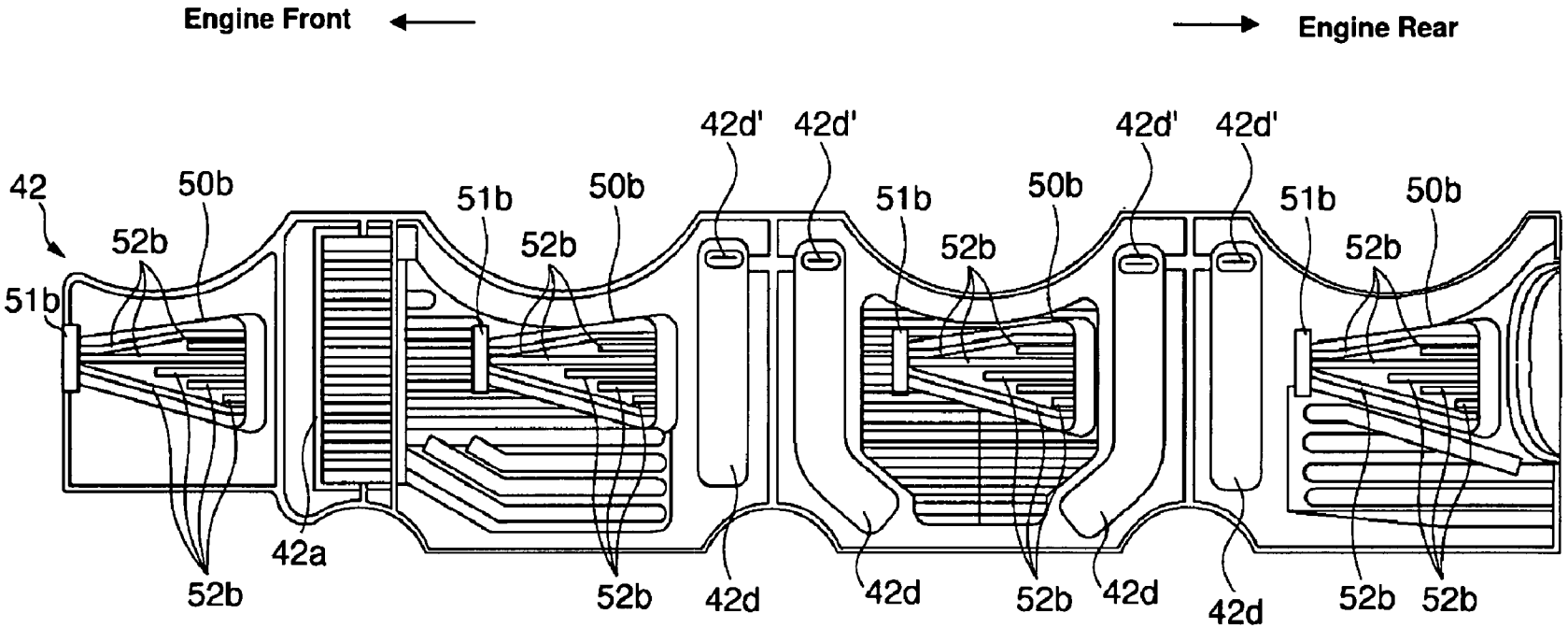
FIG. 5 is a bottom view of a baffle plate 42.

The blow-by gas hits against the obstacle plates 43 and the partition walls 42*c*, thereby conducting liquid-gas separation. The liquid occurring from this separation flows down to a groove 42*d* formed at the baffle plate 42 and then collected. FIG. 5 is a bottom view of the baffle plate 42. The groove 42*d* has a slit 42*d'* at its end portion, and the collected liquid at the groove 42*d* flows into the exhaust-side valve driving mechanism chamber via the slit 42*d'*. Meanwhile, the gas separated from the liquid of the blow-by gas is exhausted from an exhaust pipe 44 which is provided in a center chamber of the oil-separating chamber to an engine intake passage for circulation, for example.

The baffle plate 42 includes a recess portion 50*b* which is similar to the above-described recess portion 50*a*. The recess portion 50*b* is formed so that the bottom face of the baffle plate 42 is recessed upward for each cylinder. As shown in FIG. 3, the recess portion 50*b* has a section thereof which is of a reverse-V shape. The recess portion 50*b* is formed such that a slant of a portion thereof on the engine rear side is steeper than that on the engine front side. The apex of the recess portion 50*b* is located above the nozzle 25*b*. Further, a projection 51*b* which projects downward is provided at an engine-front-side end portion of the recess portion 50*b*. The projection 51*b* is located above the cam portion 22*b* disposed on the engine-front side. Further, as shown in FIG. 1, the recess portion 50*b* has a gate-shaped section thereof which is perpendicular to the axis direction of the cam shaft 20*a*.

As shown in FIGS. 1 and 5, at the bottom face of the recess portion 50*b* are provided a plurality of projections 52*b* which extend from the one cam portion 22*b* toward the other cam portion 22*b* (in other words, in the axis direction of the cam shaft 20*b*) and project downward. The projection 52*b* includes a straight portion and a bent portion. Further, as shown in FIG. 5, the recess portion 50*b* is configured such that the width thereof becomes narrower toward the engine-front-side cam portion 22*b*.

Figure 6C:
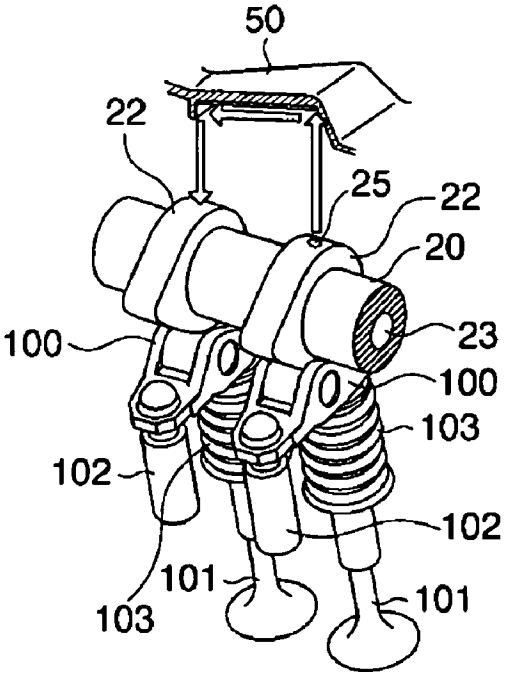
FIGS. 6A-6C are explanatory diagrams showing lubricating operations of peripheral surfaces of cam portions 22*a*, 22*b*.
Figure 6B:
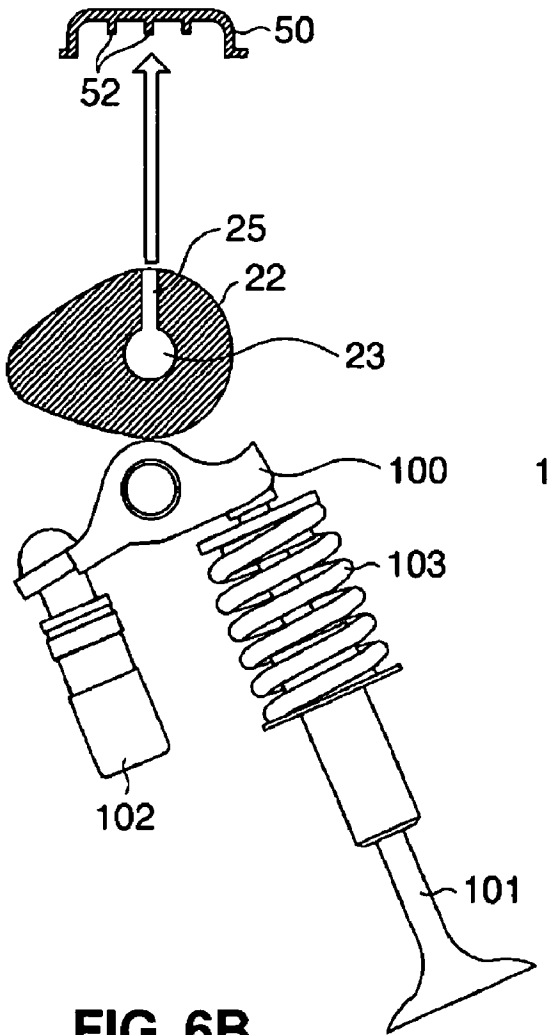
Figure 6A:
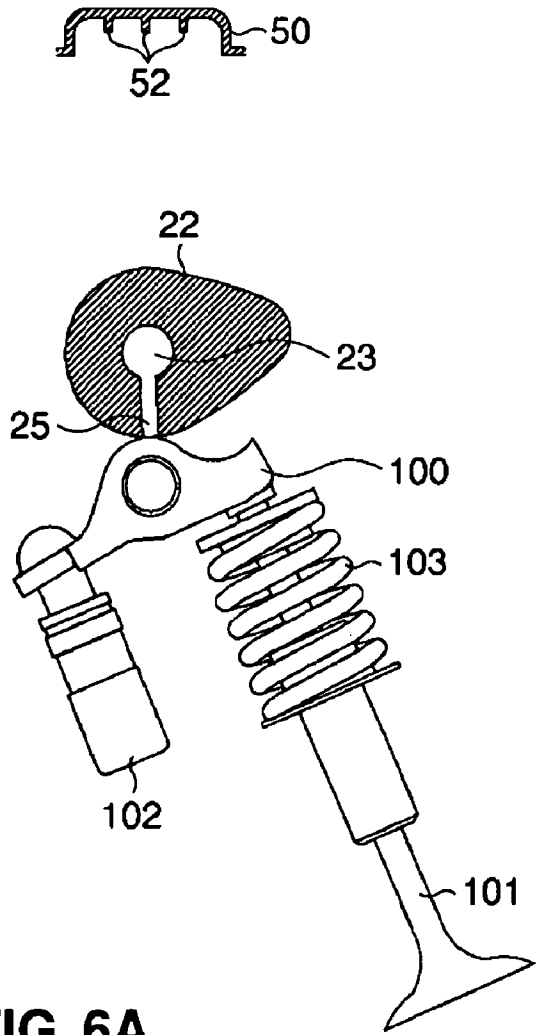

Hereinafter, lubricating operations of the peripheral surfaces of the cam portions 22*a*, 22*b* by the nozzles 25*a*, 25*b* and the recess portions 50*a*, 50*b* will be described referring to FIGS. 6A-6C. FIGS. 6A-6C are explanatory diagrams showing the lubricating operations of the peripheral surfaces of cam portions 22*a*, 22*b*. Herein, in FIG. 6A-6C and the following descriptions, the intake-side components of the cam portions 22*a*, oil passage 23*a*, nozzles 25*a*, recess portions 50*a*, cam shaft 20*a* and the exhaust-side components of the cam portions 22*b*, oil passage 23*b*, nozzles 25*b*, recess portions 50*b*, cam shaft 20*b* are commonly denoted by general reference characters of a cam portions 22, oil passage 23, nozzles 25, recess portions 50, and cam shaft 20 for simplicity of the descriptions.

The valve driving mechanism of the present embodiment, as shown in FIGS. 6A-6C, drives an intake valve or an exhaust valve 101 via a rocker arm 100 equipped with a roller, which corresponds to the slide member in the present embodiment, on which the peripheral surface of the cam portion 22 slides. Herein, another type of direct driving mechanism which uses a tappet may be also applied in place of the rocker arm 100.

The rocker arm 100 is supported at HLA (Hydraulic Lash Adjuster) 102 at one end thereof so that it can swing (rock) around its one end supported at the HLA 102. The other end of the rocker arm 100 contacts a valve stem of the valve 101. Thereby, the rotational movement of the cam portion 22 according to the rotation of the cam shaft 20 can be changed to an opening-and-closing movement of the valve 101 for an intake port or an exhaust port via the rocker arm 100. Namely, the singing (rocking) movement of the rocker arm 100 according to the rotational movement of the cam portion 22 pushes downward the valve 100 against a spring 103. The valve 100 is pushed back upward with a biasing force of the spring 103. Accordingly, the intake port or the exhaust port of the engine are opened and closed by this movement of the valve 101.

The ejection direction of the lubricating oil from the nozzle 25 changes in accordance with the rotational movement of the cam portion 22. When the cam portion 22 is positioned in a state in which the nozzle 25 is directed to the rocker arm 100 as shown in FIG. 6A, the lubricating oil is ejected to the slide portion of the rocker arm 100, so that the portion between the cam portion 22 and the rocker arm 100 can be lubricated. Meanwhile, when the cam portion 22 is positioned in a state in which the nozzle 25 is not directed to the rocker arm 100, there is a concern that the lubricating oil might be ejected wastefully into the vale-driving chamber. According to the present embodiment, however, the recess portion 50 collects the lubricating oil ejected out of the nozzle 25 of the cam portion 22 which is in the position in which the nozzle 25 is not directed to the rocker arm 100 as shown in FIG. 6B, and the collected lubricating oil is guided to the peripheral surface of the adjacent cam portion 22 without any nozzle 25 as shown in FIG. 6C.

Figure 7A:
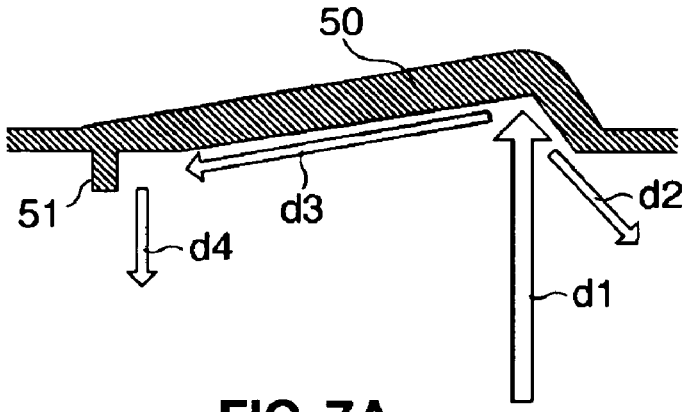
FIG. 7A is a diagram showing a manner of collection and guidance of a recess portion 50.

FIG. 7A shows the collection and guidance of the lubricating oil by the recess portion 50. As shown in this figure, the lubricating oil (an arrow d1) which has been ejected out of the nozzle 25 hits against the recess portion 50 near its apex and then it is collected here. Part of the lubricating oil hitting is spread as shown by an arrow d2, and the rest of the lubricating oil flows down to the projection 51 along the bottom face of the recess portion 50 as shown by an arrow d3. The lubricating oil flowing down drops eventually as shown by an arrow d4. Thus, the lubricating oil can be guided to the peripheral surface of the cam portion 22 without any nozzle 25 as well, thereby lubricating the slide portion between this cam portion 22 and the rocker arm 100.

As described above, the width of the recess portion 50 becomes narrower toward the other cam portion 22. Thereby, the amount of the collection of the lubricating oil ejected out of the nozzle 25 can be properly increased, and the collected lubricating oil can be guided properly to the other cam portion 22. Further, at the bottom face of the recess portion 50 are provided the plurality projections 52 which extend toward the other cam portion 22. Thereby, the lubricating oil collected by the recess portion 50 can be guided further properly to the other cam portion 22. Herein, the projection 51 can properly guide the lubricating oil to the other cam portion 22.

According to the present embodiment, the one of the cam portions 22 has the nozzle 25 to supply the lubricating oil, and the other cam portion 22 does not the nozzle 25. Thereby, the number of nozzles 25 can be reduced, so that the amount of the lubricating oil can be reduced. Meanwhile, the supply of the lubricating oil to the other cam portion 25 can be achieved by the lubricating-oil guidance of the recess portion 50. Thereby, the lubricating between the peripheral surface of the other cam portion 25 and the rocker arm 100 can be ensured as well.

Further, according to the present embodiment, the recess portion 50*a* is integrally formed at the cylinder head cover 40, and the recess portion 50*b* is integrally formed at the baffle plate 42. Thereby, the cylinder head cover 40 or the baffle plate 42 are used as the wall body, so that the number of parts can be properly reduced.

Also, according to the present embodiment, the cam portion 22 with the nozzle 25 and the cam portion 22 without the nozzle 25 which are disposed side by side are comprised of the cam portions 22*a*, 22*a* for the two intake valves and the cam portions 22*b*, 22*b* for the two exhaust valves which are provided each cylinder. Thereby, the length of the recess portion 50 can be made properly short, so that the guidance of the lubricating oil to the other cam portion 22 can be achieved surely.

Other Embodiments

Although the above-described embodiment is configured such that the lubricating oil ejected out of the nozzle 25 hits against the recess portion near its apex (FIG. 7A), the lubricating oil ejected out of the nozzle 25 may be made hit against its slant portion of the recess portion 50. Thereby, the lubricating oil ejected out of the nozzle 25 could be guided to the cam portion 22 without the nozzle more positively.

Figure 7B:
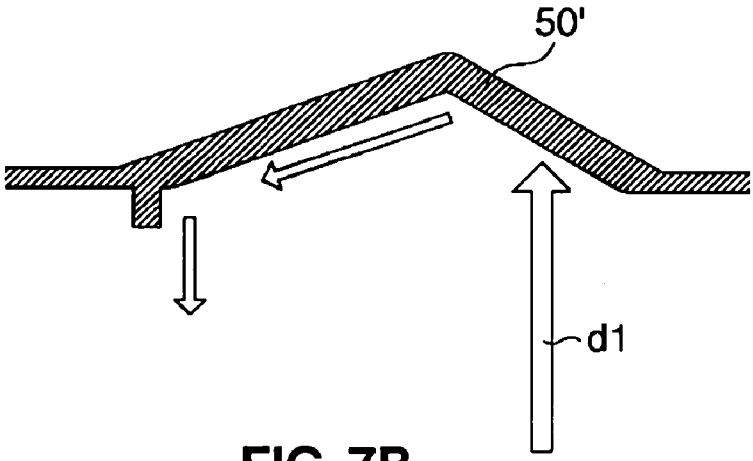
FIG. 7B is a diagram showing a sectional shape of a recess portion 50' according to another embodiment of the present invention.
Figure 7C:
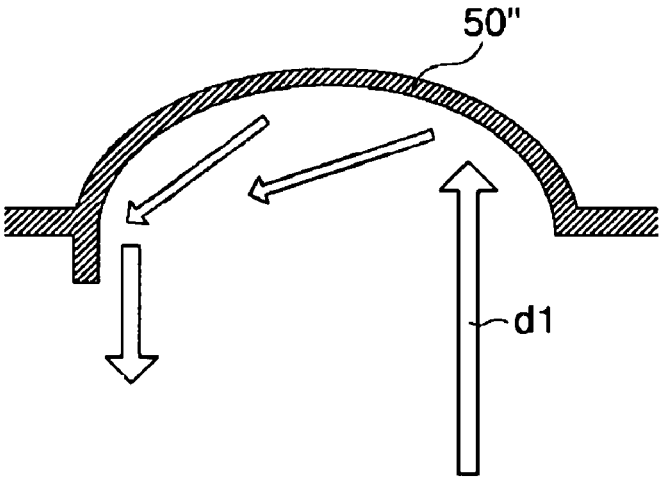
FIG. 7C is a diagram showing a sectional shape of a recess portion 50" according to further another embodiment of the present invention.

FIG. 7B shows this one other embodiment, in which the lubricating oil ejected out of the nozzle 25 (the arrow d1) hits against a slant face of a recess portion 50', thereby positively guiding the lubricating oil to the left in the figure. FIG. 7C shows further another embodiment, in which a recess portion 50" is formed such that its sectional shape is of an oval-arc shape, thereby positively guiding the lubricating oil ejected out of the nozzle 25 (the arrow d1) to the left in the figure.

The present invention should not be limited to the above-described embodiments, and any other modifications and improvements may be applied within the scope of a sprit of the present invention.

What is claimed is:

1. A lubricating device, comprising:

a cam shaft provided at a cylinder head;

a plurality of cam portions provided at the cam shaft for each valve provided the cylinder head;

a valve driving mechanism operative to change a rotational movement of the cam portion to an opening-and-closing movement of the valve via a slide member on which a peripheral surface of the cam portion slides;

an oil passage formed inside the cam shaft;

a nozzle provided at either one of the cam portions which are disposed side by side so as to open at the peripheral surface of the cam portion and connect to the oil passage formed inside the cam shaft;

a wall body having a recess portion, the recess portion being operative to collect lubricating oil ejected out of the nozzle and guide collected lubricating oil to the peripheral surface of the other of the cam portions when said one of the cam portions is located in a position in which the nozzle thereof is not directed to the slide member.

2. The lubricating device of claim 1, wherein said recess portion is configured such that the width thereof becomes narrower toward the other of the cam portions.

3. The lubricating device of claim 1, wherein at a bottom face of said recess portion are provided a plurality of projections which extend toward the other of the cam portions.

4. The lubricating device of claim 1, wherein said wall body is a cylinder head cover.

5. The lubricating device of claim 1, wherein said wall body is a baffle plate which forms an oil-separating chamber inside a cylinder head cover.

6. The lubricating device of claim 1, wherein said cam portions which are disposed side by side are cam portions for two intake or exhaust valves which are provided each cylinder.

* * * * *